US007950970B1

(12) United States Patent
Ye et al.

(10) Patent No.: US 7,950,970 B1
(45) Date of Patent: May 31, 2011

(54) TERMINAL ASSEMBLY AND METHOD OF MANUFACTURING THE SAME

(75) Inventors: Chao-Yong Ye, Guang-Dong (CN); Kai-Hsiang Chang, Tu-Cheng (TW); Kuo-Chin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/764,092

(22) Filed: Apr. 20, 2010

(51) Int. Cl.
*H01R 13/405* (2006.01)

(52) U.S. Cl. ..... 439/736

(58) Field of Classification Search ..... 439/733.1, 439/736, 722, 874, 885, 444
See application file for complete search history.

(56) References Cited

U.S. PATENT DOCUMENTS 3,654,594 A * 4/1972 Sitzler ..... 439/857
2004/0043645 A1 * 3/2004 Yamakawa et al. ..... 439/76.2
* cited by examiner

*Primary Examiner* — T C Patel
*Assistant Examiner* — Travis Chambers
(74) *Attorney, Agent, or Firm* — Cheng-Ju Chiang

(57) ABSTRACT

A terminal assembly includes a contact terminal having a base board, a driven terminal having a retention portion and an insulating block. Two opposite ends of the base board form a pair of contact portions located at one side of the base board for contacting a corresponding external terminal group. A portion of an edge of the retention portion extends to form an elastic arm. The insulating block is integrated with the contact terminal and the driven terminal by means of a substantial middle portion of the base board and a free end of the elastic arm being integrated in the insulating block. The base board of the contact terminal and the elastic arm of the driven terminal are intersected with and non-contacting with each other.

10 Claims, 3 Drawing Sheets

TERMINAL ASSEMBLY AND METHOD OF MANUFACTURING THE SAME

BACKGROUND OF THE INVENTION

1. Field of the Invention

The present invention generally relates to the field of terminals, and more particularly to a terminal assembly and a method of manufacturing the same.

2. The Related Art

Conventionally, two terminals made of metal which are respectively set on two electronic products contact with each other for forming an electrical connection between the electronic products. With the development of the electronic technology, some electronic products need a terminal assembly set thereon. The terminal assembly includes a contact terminal and a driven terminal to achieve different functions for ensuring a stable electrical connection between the electronic products. Usually, the contact terminal and the driven terminal are fixed in the insulating housing respectively by means of fixing portions formed thereon. However, the relative position of the contact terminal and the driven terminal is likely to change when in use so that affect the electrical connection between the electronic products. Therefore, a terminal assembly capable of overcoming the foregoing problem is required.

SUMMARY OF THE INVENTION

An object of the invention is to provide a terminal assembly. The terminal assembly includes a contact terminal having a base board, a driven terminal having a retention portion and an insulating block. Two opposite ends of the base board form a pair of contact portions located at one side of the base board for contacting a corresponding external terminal group. A portion of an edge of the retention portion extends to form an elastic arm. The insulating block is integrated with the contact terminal and the driven terminal by means of a substantial middle portion of the base board and a free end of the elastic arm being integrated in the insulating block. The base board of the contact terminal and the elastic arm of the driven terminal are intersected with and non-contacting with each other.

Another object of the invention is to provide a method for manufacturing the terminal assembly. The method includes following steps: stamping a first base plate to form a plurality of contact terminals in a line and a first connecting board, the adjacent contact portions of each two adjacent contact terminals apart from each other, the base boards of the contact terminals connected together by the first connecting board connecting portions of sides thereof, the first connecting board including a plurality of detached parts to make areas between the parts facing middles of the base boards; stamping a second base plate to form a plurality of driven terminals apart from one another and a second connecting board connecting the driven terminals together; fixing the first and the second base plate in a mold, with the elastic arms of the driven terminals located in the areas between the corresponding parts and free ends of the elastic arms non-contacting with the corresponding base boards; injecting the fluent plastic material into the mold to form insulating blocks integrated with the substantial middle portions of the base boards of the contact terminals and the free ends of the elastic arms of the driven terminals; cutting off the first and second connecting boards to form a plurality of detached terminal assemblies.

As described above, the substantial middle portion of the base board and the free end of the elastic arm are integrated in the insulating block so as to make the relative position of the contact terminal and the driven terminal stay constant for providing a more stable electrical connection between the terminal assembly and the corresponding external terminal group.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
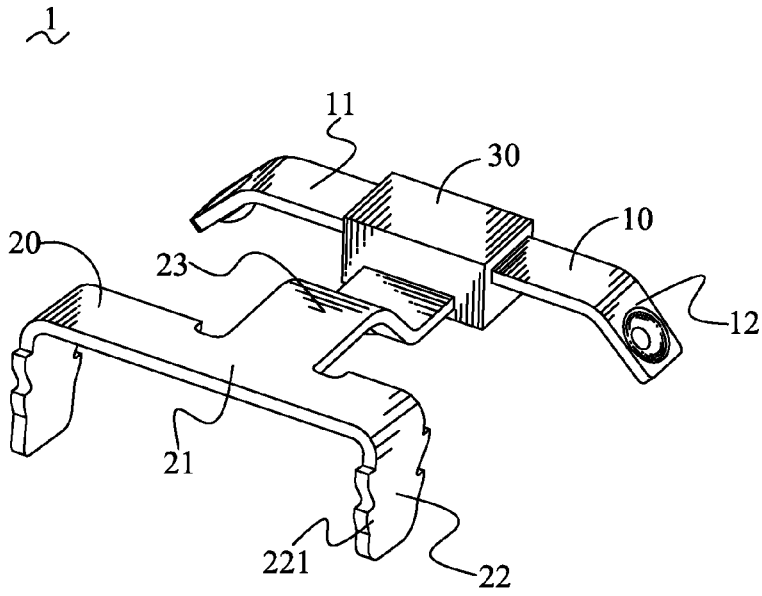
FIG. 1 is a perspective view of a terminal assembly in accordance with the present invention.

Referring to FIG. 1, a terminal assembly 1 according to the present invention is shown. The terminal assembly 1 is used for connecting two electronic products (not shown) by means of contacting with a corresponding terminal group (not shown). The terminal assembly 1 includes a contact terminal 10, a driven terminal 20 and a substantial rectangular insulating block 30 molded with the contact terminal 10 and the driven terminal 20.

Figure 2:
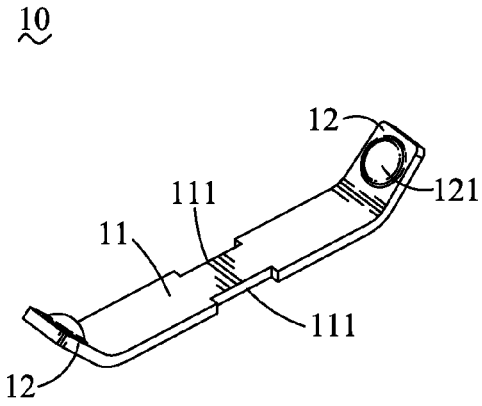
FIG. 2 is a perspective view of a contact terminal of the terminal assembly of FIG. 1.

Referring to FIGS. 1-2, the contact terminal 10 has a flat base board 11. Two opposite ends of the base board 11 are inclined downwardly to form a pair of contact portions 12 symmetrically located at one side of the base board 11 and contacting with the corresponding terminal group. The inclination angle of each of the contact portions 12 from the base board 11 is substantially 45 degrees. Portions of insides of the contact portions 12 are protruded inward to form a pair of semi-spherical projections 121 for making the electrical connection between the terminal assembly 1 and the corresponding terminal group more stable. Middle portions of two opposite side edges of the base board 11 are recessed inward to form a pair of rectangular fixing grooves 111 each extending along an extending direction of the base board 11.

Figure 3:
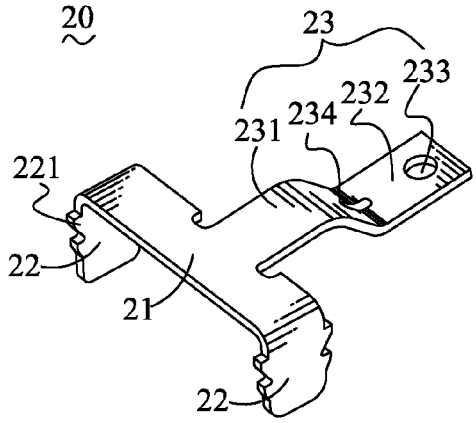
FIG. 3 is a perspective view of a driven terminal of the terminal assembly of FIG. 1.

Referring to FIG. 1 and FIG. 3, the driven terminal 20 has a substantial rectangular flat retention portion 21. Two ends of the retention portion 21 are bent downwardly to form a pair of holding portions 22 facing each other for being held in an insulating housing (not shown). A plurality of barbs 221 are protruded outward from two opposite side edges of the holding portion 22. A middle of an edge of the retention portion 21 extends outwardly to form a step-shaped elastic arm 23 including a lower portion 232, an upper portion 231 and a slope 234 smoothly connecting the lower portion 232 and the upper portion 231. The upper portion 231 is extended from the retention portion 21 and located at the same plane with the retention portion 21. The lower portion 232 is located at different planes with the retention portion 21. The elastic arm 23 and the retention portion 21 cooperate to show a substantial inverse-T shape. The lower portion 232 of the elastic arm 23 defines a circular hole 233 passing therethrough. The contact terminal 10 and the driven terminal 20 are integrated with insulating block 30 by means of a substantial middle portion of the base board 11 of the contact terminal 10 and a free end of the lower portion 232 of the elastic arm 23 being integrated in the insulating block 30, intersected and non-contacting with each other so that make the contact terminal 10 gain some elasticity from the driven terminal 20. The base board 11 of the contact terminal 10 is at the same plane with the retention portion 21 of the driven terminal 20. The contact terminal 10 and the driven terminal 20 cooperate to show a substantial lying-H shape. The contact portions 12 of the contact terminal 10 and the holding portions 22 of the driven terminal 20 are at the same side of the insulating block 30.

Figure 4:
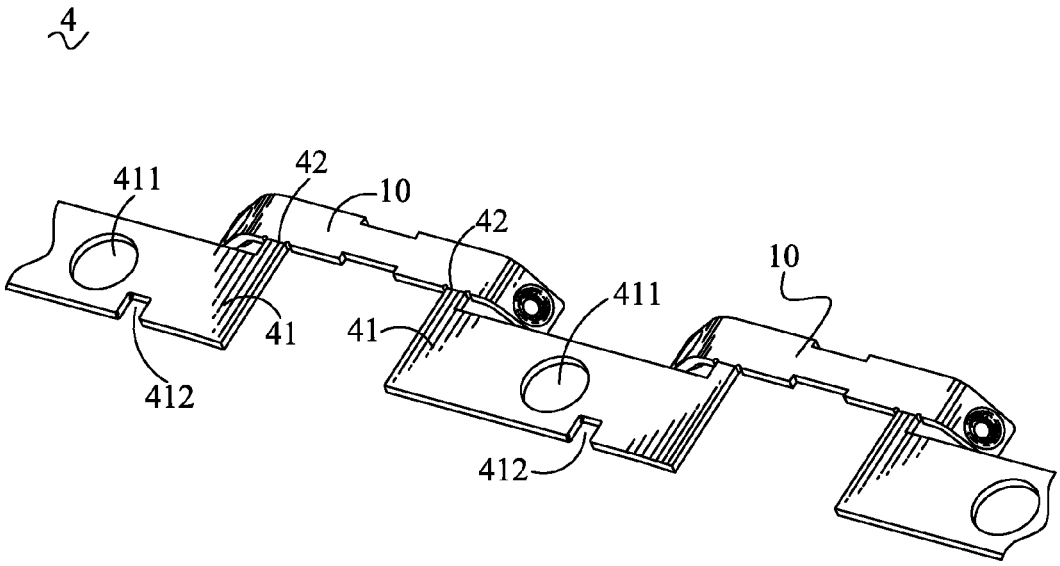
FIG. 4 is a perspective view of a first base plate of a terminal assembly and a method of manufacturing the same.
Figure 5:
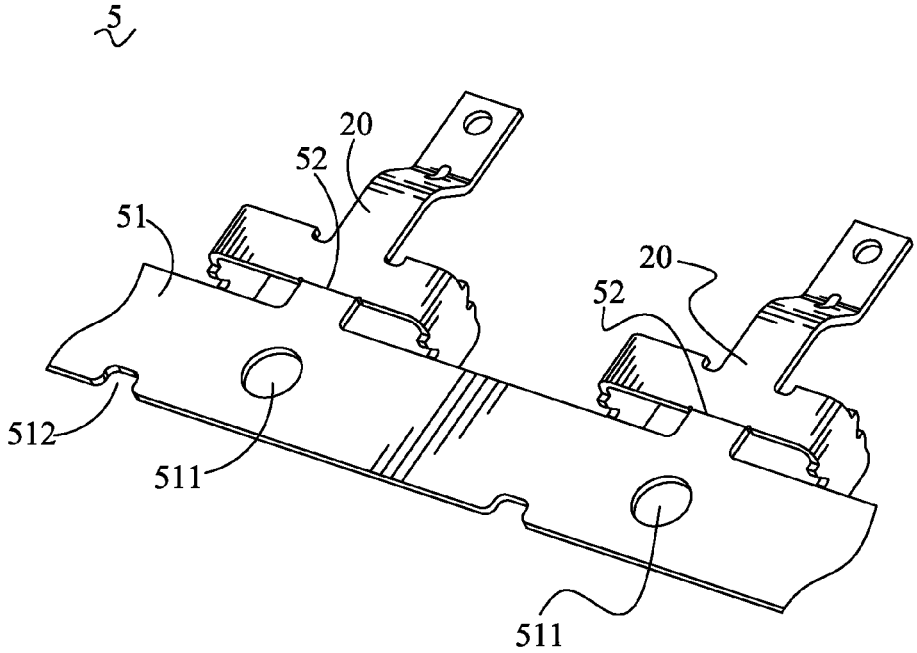
FIG. 5 is a perspective view of a second base plate of the terminal assembly and method of manufacturing the same.
Figure 6:
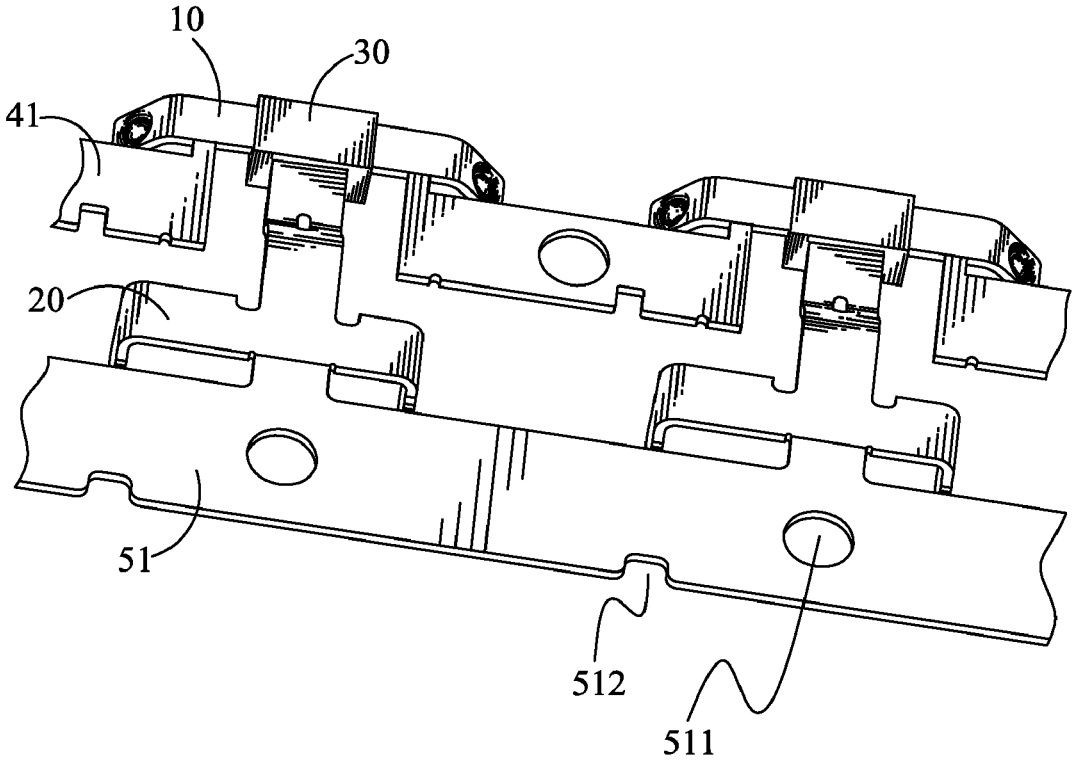
FIG. 6 is a perspective view showing the first base plate and the second base plate partly integrated with an insulating block.

Referring to FIGS. 4-6, the method for manufacturing the terminal assembly 1 includes following steps:

Firstly, stamping a first base plate 4 to form a plurality of contact terminals 10 in a line apart from one another, a first connecting board 41 connecting the contact terminals 10 together and a first pre-cut line 42. The adjacent contact portions 12 of each two adjacent contact terminals 10 are apart from each other and the base boards 11 of the contact terminals 10 are connected together by the first connecting board 41 connecting portions of sides thereof. The first connecting board 41 includes a plurality of detached parts to make areas between the detached parts facing middles of the base boards 11. The first pre-cut line 42 is located at the joint of the first connecting board 41 and the base boards 11 of the contact terminals 10. Stamp a second base plate 5 to form a plurality of driven terminals 20 apart from one another, a second connecting board 51 connecting the driven terminals 20 together and a second pre-cut line 52. The adjacent holding portions 22 of each two adjacent driven terminals 20 are apart from each other and the retention portions 21 of the driven terminals 20 are connected together by the second connecting board 51 connecting portions of sides thereof. The second connecting board 51 is cut to form a plurality of parts to connect substantial middles of the retention portions 21. The second pre-cut line 52 is located at the joint of the second connecting board 51 and the retention portions 21 of the driven terminals 20. The first and second connecting boards 41, 51 define a plurality of first and second circular windows 411, 511 arranged at regular intervals at middle portions thereof and a plurality of first, second fixing notches 412, 512 arranged at regular intervals at an edge thereof, respectively.

Secondly, fixing the first and second base plates 4, 5 in a mold, with the base board 11 of contact terminal 10 paralleling to and being at the same plane with the retention portion 21 of driven terminal 20 respectively. The elastic arms 23 of the driven terminals 20 are located in the areas between the corresponding detached parts of the first connecting board 41 and the substantial middle portion of base board 11 of the contact terminal 10 suspended over the free end of the lower portion 232 of the elastic arm 23 of the driven terminal 20. The first windows 411 of the first base plate 41 and the second window 511 of the second base plate 51 are used for fixing the driven terminal 20 and the contact terminal 10 in the mold, the first and second notches 412, 512 are used for preventing the first base plate 4 and the second base plate 5 being fixed in the mold from a mistake direction.

Thirdly, injecting fluent plastic material into the mold to form the insulating blocks 30 integrated with the substantial middle portions of the base boards 11 of the contact terminals 10 and the free ends of the lower portions 232 of the driven terminals 20. During molding, the fluent plastic material flows into the hole 233 of each of the driven terminals 20 and the fixing grooves 111 of each of the contact terminals 10 so as to make the hole 233 and the fixing grooves 111 be filled with the fluent plastic material and then the fluent plastic material overflows the base board 11 and the end of the elastic arm 23 respectively to make the base board 11 and the lower portion 232 of the elastic arm 23 be surrounded by the fluent plastic material, which enhances the retention of the contact terminal 10 and the driven terminal 20 in the insulating block 30.

Lastly, cutting off the first and second connecting boards 41, 51 along the first and second pre-cut lines 42, 52, respectively, to form a plurality of detached terminal assemblies 1.

As described above, the substantial middle portion of the base board 11 and the free end of the lower portion 232 of the elastic portion 23 is integrated in the insulating block 30 so as to make the relative position of the contact terminal 10 and the driven terminal 20 stay constant for providing a more stable electrical connection between the electronic products.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A terminal assembly, comprising:

a contact terminal having a base board, two opposite ends of the base board forming a pair of contact portions located at one side of the base board for contacting a corresponding external terminal group;

a driven terminal having a retention portion, a portion of an edge of the retention portion extending to form an elastic arm; and an insulating block integrated with the contact terminal and the driven terminal by means of a substantial middle portion of the base board and a free end of the elastic arm being integrated in the insulating block, the base board of the contact terminal and the elastic arm of the driven terminal being intersected with and non-contacting with each other.

2. The terminal assembly as claimed in claim 1, wherein the elastic arm is step-shaped, including a lower portion, an upper portion and a slope smoothly connecting the lower portion and the upper portion, the upper portion is extended from the retention portion, the lower portion is integrated in the insulating block.

3. The terminal assembly as claimed in claim 1, wherein the base board is substantially parallel to the retention portion when the insulating block is integrated with the contact terminal and the driven terminal.

4. The terminal assembly as claimed in claim 1, wherein two opposite edges of the portion of the base board are recessed inward to form a pair of fixing grooves for making the base board integrated in the insulating block more firmly.

5. The terminal assembly as claimed in claim 1, wherein the lower portion of the elastic arm defines a hole for making the lower portion of the elastic arm integrated in the insulating block more firmly.

6. The terminal assembly as claimed in claim 1, wherein two opposite ends of the retention portion are bent to form a pair of holding portions located at the same side with the contact portions of the contact terminal for being held in an insulating housing.

7. A method for manufacturing a terminal assembly as claimed in claim 1, comprising:

stamping a first base plate to form a plurality of contact terminals in a line and a first connecting board, the adjacent contact portions of each two adjacent contact terminals apart from each other, the base boards of the contact terminals connected together by the first connecting board connecting portions of sides thereof, the first connecting board being cut to form a plurality of detached parts to make areas between the parts facing middles of the base boards, stamping a second base plate to form a plurality of driven terminals apart from one another and a second connecting board connecting the driven terminals together;

fixing the first and the second base plate in a mold, with the elastic arms of the driven terminals located in the areas between the corresponding parts and free ends of the elastic arms non-contacting with the corresponding base boards;

injecting the fluent plastic material into the mold to form insulating blocks integrated with the substantial middle portions of the base boards of the contact terminals and the free ends of the elastic arms of the driven terminals; and cutting off the first and second connecting boards to form a plurality of detached terminal assemblies.

8. The terminal assembly as claimed in claim 1, wherein the contact portions are inclined towards a same side from the two opposite ends of the base board.

9. The terminal assembly as claimed in claim 8, wherein the contact portions are symmetrical about the base board.

10. The terminal assembly as claimed in claim 8, wherein portions of insides of the contact portions are protruded inward to form a pair of semi-spherical projections.

* * * * *